United States Patent [19]

Bearden, Jr. et al.

[11] 4,424,110

[45] Jan. 3, 1984

[54] HYDROCONVERSION PROCESS

[75] Inventors: Roby Bearden, Jr.; William C. Baird, Jr.; Clyde L. Aldridge, all of Baton Rouge, La.

[73] Assignee: Exxon Research and Engineering Co., Florham Park, N.J.

[21] Appl. No.: 345,340

[22] Filed: Feb. 3, 1982

Related U.S. Application Data

[63] Continuation-in-part of Ser. No. 182,507, Aug. 29, 1980, abandoned.

[51] Int. Cl.[3] ..... C10G 1/08; C10G 47/02

[52] U.S. Cl. ..... 208/10; 208/108; 208/112

[58] Field of Search ..... 208/10, 108, 112

[56] References Cited

U.S. PATENT DOCUMENTS

| | | | |
|---|---|---|---|
| 2,119,647 | 6/1938 | Pier et al. | 208/10 |
| 3,131,142 | 4/1964 | Mills, Jr. | 208/108 |
| 3,232,861 | 2/1966 | Gorin et al. | 208/10 |
| 4,038,173 | 7/1977 | Myers | 208/112 |
| 4,077,867 | 3/1978 | Aldridge et al. | 208/10 |
| 4,169,041 | 9/1979 | Schuette | 208/10 |
| 4,192,735 | 3/1980 | Aldridge et al. | 208/112 |
| 4,203,759 | 5/1980 | Metrailer et al. | 48/206 |
| 4,204,943 | 5/1980 | Metrailer et al. | 208/8 LE |
| 4,298,454 | 11/1981 | Aldridge et al. | 208/108 X |
| 4,313,818 | 2/1982 | Aldridge et al. | 208/112 X |

FOREIGN PATENT DOCUMENTS

| | | | |
|---|---|---|---|
| 18642 | 7/1935 | Australia | 208/10 |
| 457211 | 11/1936 | United Kingdom | 208/10 |
| 463602 | 4/1937 | United Kingdom | 208/10 |

*Primary Examiner*—Delbert E. Gantz
*Assistant Examiner*—William G. Wright
*Attorney, Agent, or Firm*—Marthe L. Gibbons

[57] ABSTRACT

Carbonaceous feeds such as hydrocarbonaceous oils and coal are hydroconverted in the presence of a combination of a hydrogen halide and a metal-containing catalyst produced in situ in the feed. The hydrogen halide is present in an amount to provide from about 0.1 to 20 moles of hydrogen halide per atom of the metal constituent of the catalyst to increase the activity of the catalyst.

16 Claims, 1 Drawing Figure

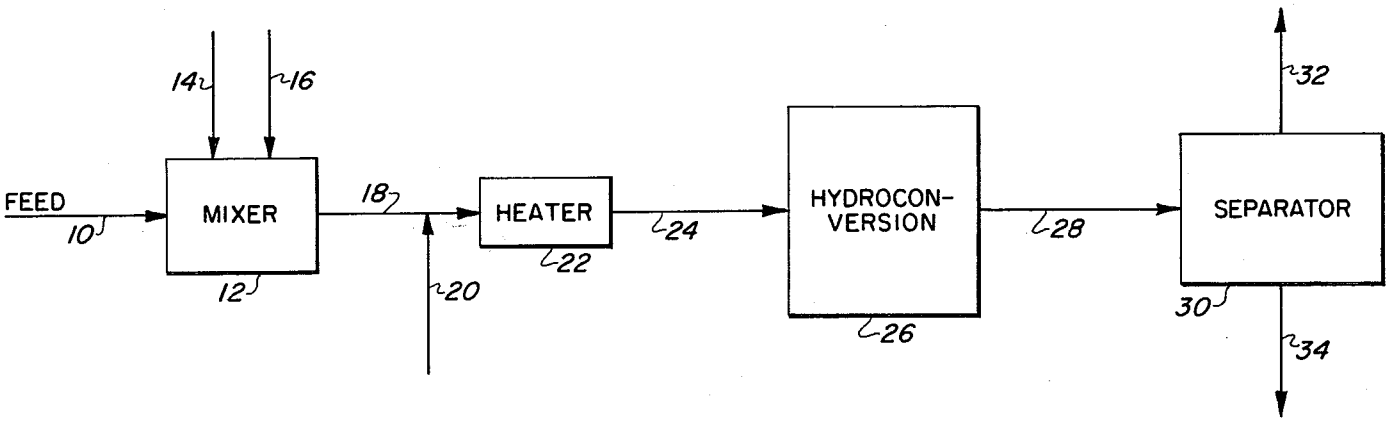
FEED
10
14
16
MIXER
12
18
20
HEATER
22
24
HYDROCON-
VERSION
26
28
SEPARATOR
30
32
34

HYDROCONVERSION PROCESS

CROSS REFERENCE TO RELATED APPLICATION

This application is a continuation-in-part of U.S. Ser. patent application No. 182,507, filed Aug. 29, 1980, now abandoned, the teachings of which are hereby incorporated by reference.

BACKGROUND OF THE INVENTION

1. Field of the Invention

This invention relates to an improvement in the process for converting a carbonaceous fuel such as hydrocarbonaceous oil, coal or mixtures thereof in the presence of hydrogen and a metal-containing catalyst prepared in situ in the feed.

2. Description of the Prior Art

Hydroconversion processes conducted in the presence of hydrogen and a hydroconversion catalyst are well known.

The term "hydroconversion" with reference to the oil feed is used herein to designate a process conducted in the presence of hydrogen in which at least a portion of the heavy constituents (as measured by Conradson carbon residue) of the oil feed is converted to lower boiling hydrocarbonaceous products.

The term "hydroconversion" with reference to the coal feed is used herein to designate conversion of coal to normally liquid hydrocarbon products in the presence of hydrogen.

U.S. Pat. No. 3,123,550 discloses the addition of mineral acids to distillate chargestock of a hydrotreating process utilizing a conventional hydrogenation catalyst.

U.S. Pat. No. 3,282,828 discloses hydrorefining of petroleum crude oils utilizing an unsupported vanadium halide.

U.S. Pat. No. 2,057,629 discloses the refining of hydrocarbon oils with hydrochloric acid in the presence of a metal oxide which may be vanadium oxide.

U.S. Pat. No. 3,700,583 discloses coal liquefaction in a hydrogen donor solvent in the presence of a carbon radical scavenger which may be a hydrogen halide.

It has now been found that utilization of a combination of hydrogen halide and a metal-containing catalyst produced in situ in the feed in specified ratio will increase the activity of the catalyst.

SUMMARY OF THE INVENTION

In accordance with the invention there is provided, in a process for the hydroconversion of a carbonaceous feed which comprises (a) forming a mixture of said carbonaceous feed and a thermally decomposable metal compound wherein said metal compound comprises at least one metal constituent selected from the group consisting of Groups II, III, IVB, VB, VIB, VIIB, VIII and mixtures thereof of the Periodic Table of Elements; (b) reacting the resulting mixture with a hydrogen-containing gas at hydroconversion conditions, in a hydroconversion zone, said metal compound being converted to a metal-containing catalyst within said mixture at said conditions, and recovering a normally liquid hydrocarbon product, the improvement which comprises said reaction being conducted in the presence of a hydrogen halide in an amount such as to provide a ratio of about 0.1 to 20 moles hydrogen halide per atom of said metal constituent.

BRIEF DESCRIPTION OF THE DRAWING

The FIGURE is a schematic flow plan of one embodiment of the invention.

DESCRIPTION OF THE PREFERRED EMBODIMENT

The process of the invention is generally applicable for the hydroconversion of carbonaceous feeds such as hydrocarbonaceous oils, coal and mixtures thereof. Suitable hydrocarbonaceous oil chargestocks include heavy mineral oils; whose or topped petroleum crude oils, including heavy crude oils; asphaltenes, residual oils such as atmospheric residua boiling above about 650° F. at atmospheric pressure and petroleum vacuum residua boiling above about 1050° F. at atmospheric pressure; tars; bitumen; tar sand oils; shale oils; hydrocarbonaceous oils derived from coal liquefaction processes, including coal liquefaction bottoms. The term "coal" is used herein to designate normally solid carbonaceous material including all ranks of coal, such as anthracite coal, bituminous coal, semibituminous coal, subbituminous coal, lignite, peat and mixtures thereof. The process is applicable for the simultaneous conversion of mixtures of coal and a hydrocarbonaceous oil.

The hydroconversion catalysts suitable for use in combination with the hydrogen halides are, for example, catalysts produced in situ in the carbonaceous feed such as the catalysts and slurry processes described in U.S. Pat. Nos. 4,134,825; 4,077,867, the teachings of which are hereby incorporated by specific reference.

Referring to the FIGURE, a carbonaceous feed is introduced by line 10 into mixer 12. When coal is used as carbonaceous feed, the coal would be present as coal particles in a liquid medium which may be an organic diluent such as a hydrocarbonaceous liquid, including liquids derived from coal liquefaction processes, and coal liquefaction bottoms. A thermally decomposable metal compound, or solution of thermally decomposable metal compound, which is soluble or dispersible in the liquid medium, or when a hydrocarbonaceous oil feed is used, in the hydrocarbonaceous oil, is introduced into mixer 12 by line 14 to the feed. The metal compound is the precursor of the metal-containing hydroconversion catalyst which is formed in situ in the carbonaceous feed when the feed containing the precursor is heated to an elevated temperature.

Suitable thermally decomposable (under process conditions) metal compounds include inorganic poly acids such as isopoly and heteropoly acids; metal carbonyls; metal salts of organic acids such as acyclic and alicyclic aliphatic carboxylic acids (e.g. naphthenic acids), and metal halides. The metal constituent of the thermally decomposable compound is selected from the group consisting of Groups II, III, IVB, VB, VIB, VIIB, VIII of the Periodic Table of Elements and mixtures thereof, in accordance with the table published by Sargent-Welch, copyright 1968, Sargent-Welch Scientific Company, for example, zinc, titanium, cerium, zirconium, vanadium, niobium, tantalum, chromium, molybdenum, tungsten, manganese, rhenium, iron, cobalt, nickel and the noble metals including platinum, iridium, palladium, osmium, ruthenium and rhodium. The preferred metal constituent of the thermally decomposable metal compound is selected from the group consisting of Groups VB and VIB of the Periodic Table of Elements and mixtures thereof. The preferred thermally decomposable compounds are the metal salts of acyclic and alicyclic aliphatic carboxylic acids; isopoly acids and heteropoly acids of metals selected from the group consisting of Groups VB and VIB of the Periodic Table of Elements, that is, vanadium, niobium, chromium, molybdenum, tungsten and mixtures thereof. The terms "heteropolyacid" and "isopoly acid" are used herein in accordance with the definition given in *Advanced Inorganic Chemistry,* 3rd Edition, by S. A. Cotton and Geoffrey Wilkinson, Interscience Publishers, New York, pages 950–957. Suitable inorganic poly acids include phosphomolybdic acid, phosphotungstic acid, phosphovanadic acid, silicomolybdic acid, silicotungstic acid, silicovanadic acid and mixtures thereof. The preferred metal constituent of the poly acid is selected from the group consisting of molybdenum, vanadium and chromium. The preferred poly acid is phosphomolybdic acid. Suitable concentrations of the thermally decomposable metal compound range from about 1 to about 2000 wppm, preferably from about 5 to about 950 wppm, more preferably from about 10 to 300 wppm, calculated as the elemental metal, based on the carbonaceous feed, that is, when the feed is coal, it is based on coal alone; when the feed is a hydrocarbonaceous oil, it is based on the oil feed; and when the feed is a mixture of coal and oil, it is based on both.

A hydrogen halide, preferably hydrogen chloride, or a hydrogen halide precursor such as, for example, the halogens, alkyl halides or aryl halides, is introduced into mixer 12 by line 16 in an amount such as to provide a ratio from about 0.1 to about 20 moles hydrogen halide per atom of the metal constituent of the thermally decomposable metal compound, preferably a ratio from about 0.5 to about 10 moles hydrogen halide per atom of metal constituent of the thermally decomposable metal compound more preferably a ratio from about 1 to about 5 moles hydrogen halide per atom of said metal constituent. When the thermally decomposable metal compound comprises more than one metal constituent, the given ratio of moles of hydrogen halide would apply per atom of the mixture of metal constituents. It has to be understood that the hydrogen halide or the hydrogen halide precursor could be added to the feed carried in line 10 or added to the preheated feed in line 24 or added directly to the thermally decomposable metal compound or to a solution of the thermally decomposable metal compound instead of being introduced into the mixer. Alternatively, the hydrogen halide or the hydrogen halide precursor could be introduced directly into hydroconversion zone 26. The mixture is removed from mixer 12 by line 18. A hydrogen-containing gas is introduced into the mixture by line 20. The hydrogen-containing gas may comprise from about 1 to about 10 mole percent hydrogen sulfide. The carbonaceous feed hydrogen halide-thermally decomposable metal compound-hydrogen mixture is then passed to heater 22 where the mixture is preheated. The preheated mixture is removed by line 24, passed to a hydroconversion zone in reactor 26. The thermally decomposable metal compound is converted to the corresponding metal-containing catalyst at hydroconversion conditions. The hydroconversion reaction zone in reactor 26 is maintained at a temperature ranging from about 600° to about 850° F., preferably from about 700° to about 800° F., and at a hydrogen partial pressure ranging from about 500 to about 5000 psig, preferably from about 1000 to about 3000 psig. The contact time may vary widely depending on the desired conversion level. Suitable contact times may range from about 0.1 to 10 hours, preferably from about 0.15 to 4 hours, more preferably from about 0.5 to 2.0 hours. The mixed phase product effluent of the hydroconversion zone is removed from reactor 26 by line 28 and passed to separator 30 where it is separated by conventional means into a predominantly vaporous phase comprising light normally gaseous hydrocarbons and hydrogen, removed by line 32 and a principally liquid phase removed by line 34. The vaporous phase may be further separated by conventional means to obtain a hydrogen-rich gas, which if desired, may be recycled to hydroconversion zone 26. The normally liquid hydrocarbon phase may be separated into fractions, as is well known in the art. For example, the normally liquid hydrocarbon phase may be separated into a naphtha stream, a middle distillate stream and a residual fraction containing the catalyst. If desired, at least a portion of the residual fraction containing the catalyst may be recycled to the hydroconversion process. Furthermore, it is also possible to separate the catalyst from the reactor effluent or from a concentrated product residual stream by conventional means known in the art, such as by filtration, centrifugation, settling and drawoff. If desired, at least a portion of the separated catalyst may be recycled to the process either directly into the hydroconversion zone or into the feed line or into the mixer. After the catalytic solids are recycled, the addition of thermally decomposable metal compound to the feed may be decreased or discontinued.

The following examples are presented to illustrate the invention.

EXAMPLE 1

Comparative hydroconversion experiments were made utilizing as feed a Cold Lake crude oil having a nitrogen content of 0.44 weight percent, a sulfur content of 4.3 weight percent, a Conradson carbon content of 12.9 weight percent, a nickel content of 74 parts per million parts by weight (wppm) and a vanadium content of 174 wppm. The thermally decomposable compound used as precursor for the in situ formed catalyst was molybdenum naphthenate, a naphthenic acid salt containing 6 weight percent molybdenum supplied by Shepherd Chemical Company. The precursor for in situ formed hydrogen chloride was tertiary-amyl chloride.

The experiments were carried out in the following manner. In Experiment No. R-129, which is not in accordance with the present invention, a 300 cc stirred autoclave of Hastelloy-C construction was charged with 100 g of Cold Lake crude and 0.5 g of a solution comprising 36 weight percent molybdenum naphthenate in xylene, an amount sufficient to give a molybdenum concentration on feed of 108 wppm. In the experiment designated R-131, which is an experiment in accordance with the process of this invention, there was also charged 0.5 g of a solution containing 10 weight percent t-amyl chloride in xylene, an amount sufficient to furnish a ratio of 4.1 gram-moles of HCl per gram-atom of molybdenum. The molybdenum naphthenate and t-amyl chloride solutions were blended together prior to charging to the autoclave. In both experiments, the autoclave was subsequently charged with 200 psig $H_2S$ and 1300 psig $H_2$ after which it was heated with stirring for 30 minutes at 725° F., cooled rapidly to room temperature and depressured. This completed the pretreatment step of the experiments. Next, the autoclave was charged with 2000 psig $H_2$ at room temperature and then heated with stirring at 830° F. for 60 minutes to carry out the hydroconversion reaction. Upon cooling to room temperature, the autoclave was vented to recover gaseous products and the remaining contents filtered to recover solid and liquid products.

As can be seen by comparing the experimental results given in Table I, the addition of the HCl precursor, t-amyl chloride, markedly improved hydroconversion performance. In the chloride-containing experiment, R-131, metals removal, Conradson carbon conversion and coke suppression were substantially better than in the chloride-free control experiment, R-129.

TABLE I

COLD LAKE CRUDE HYDROCONVERSION WITH CATALYST FORMED IN SITU FROM MOLYBDENUM NAPHTHENATE AND HCl PRECURSOR

| EXPERIMENT NO. | R-129 | R-131 |
|---|---|---|
| g-Moles HCl/g-atom Mo | 0 | 4.1 |
| Autoclave Charge, g. | | |
| Cold Lake Crude | 100.0 | 100.0 |
| Catalyst Solution | 0.32 | 0.72 |
| Xylene | | |
| Molybdenum Naphthenate | 0.18 | 0.18 |
| t-amyl Chloride | 0.00 | 0.05 |
| Yields, Wt. % on Feed | | |
| $C_1$-$C_4$ | 3.6 | 3.2 |
| Coke | 2.6 | 1.2 |
| $C_5$+ Liquid (by difference) | 93.8 | 95.6 |
| Conversion Summary | | |
| Nickel Removed, % | 62 | 72 |
| Vanadium Removed, % | 66 | 76 |
| Conradson Carbon Conversion, % | 50 | 61 |

EXAMPLE 2

A second set of comparative hydroconversion experiments was made in the 300 cc batch autoclave using the Cold Lake crude feed and the molybdenum naphthenate catalyst precursor of Example 1. However, in the HCl containing experiment of this set, anhydrous HCl gas was substituted for the HCl precursor, t-amyl chloride. Also, the pretreatment step used in the experiments of Example 1 was omitted. The quantities of reactants used, the hydroconversion reaction conditions and the experimental results are given in Table II.

TABLE II

COLD LAKE CRUDE HYDROCONVERSION WITH CATALYST FORMED IN SITU FROM MOLYBDENUM NAPHTHENATE AND ANHYDROUS HCl

| EXPERIMENT NO. | 49-R-26 | R-386 |
|---|---|---|
| g-Moles HCl/g-atom Mo | 0 | 14.7/1 |
| Autoclave Charge, g. | | |
| Cold Lake Crude | 95.00 | 95.10 |
| Molybdenum Naphthenate | 1.10 | 1.10 |
| Anhydrous HCl | 0.00 | 0.37 |
| Hydroconversion Conditions | | |
| Temperature, °F. | 820 | 820 |
| Contact Time, Minutes | 40 | 40 |
| Pressure, Avg. psig | 2500 | 2500 |
| Yields, Wt. % on Oil Feed | | |
| $C_1$-$C_4$ gas | 2.8 | 1.5 |
| Coke | 0.7 | 0.9 |
| $C_5$+ Liquid (by difference) | 96.5 | 97.6 |
| Conversion Summary | | |
| Nickel Removed, % | 80 | 93 |
| Vanadium Removed, % | 88 | 99 |
| Conradson Carbon Conversion, % | 51 | 70 |
| Sulfur Removed, % | 47 | 52 |

As can be seen by comparing the experimental results given in Table II, the addition of anhydrous hydrogen chloride improved hydroconversion performance. In the HCl-containing experiment, R-386, metals removal, sulfur removal, and Conradson carbon conversion were substantially better than in the HCl-free control experiment, 49-R-26.

EXAMPLE 3

A third set of comparative experiments was made using as feed a topped Cold Lake crude oil having an initial boiling point of 850° F., a sulfur content of 5.6 wt.%, a Conradson carbon content of 20.0 wt.%, a nickel content of 110 wppm and a vanadium content of 260 wppm. The precursor for the in-situ formed catalyst was a phosphomolybdic acid (PMA), 2 $H_3PO_4$.20 $moO_3$.48 $H_2O$, supplied by J. T. Baker and Company. PMA was dissolved in deionized water prior to use. HCl was added as a 38 wt.% solution of HCl in water.

The experiments were carried out in the following manner, using the autoclave reactor described in Example 1. In the experiment designated R-509, which is an experiment in accordance with this invention, the autoclave was charged with 95.0 g of topped Cold Lake crude and 1.67 g of a solution containing 16.67 wt.% PMA and 9.10 wt.% of the hydrochloric acid solution and 74.23% deionized water. In experiment R-502, which is not in accordance with this invention, the autoclave charge consisted of 98.5 g of topped crude and 1.67 g of a solution comprised of 16.5 wt.% PMA in deionized water. In both experiments, the autoclave was subsequently charged with 50 psig $H_2S$ and 2350 psig $H_2$, heated for 30 minutes at 725° F. followed by 60 minutes at 800° F., then cooled to room temperature and vented to recover gaseous products. Liquid and solid products were recovered by filtering the remaining autoclave contents. Experimental results are given in Table III.

TABLE III

TOPPED COLD LAKE CRUDE HYDROCONVERSION WITH CATALYST FORMED IN SITU FROM MIXTURE OF AQUEOUS PHOSPHOMOLYBDIC ACID AND HCl

| EXPERIMENT NO. | R-502 | R-509 |
|---|---|---|
| g-Moles HCl/g-atom Mo | 0 | 1.13 |
| Autoclave Charge, g. | | |
| Cold Lake Crude | 98.50 | 95.00 |
| Catalyst Solution | | |
| Phosphomolybdic Acid | 0.28 | 0.28 |
| Deionized Water | 1.24 | 1.39 |
| Hydrochloric Acid (38 wt. %) | 0.00 | 0.15 |
| Yields, Wt. % on Oil Feed | | |
| $C_1$-$C_4$ | 2.3 | 2.1 |
| Coke | 0.3 | 0.3 |
| $C_5$+ Liquid (by difference) | 97.4 | 97.6 |
| Conversion Summary | | |
| Nickel Removed, % | 76 | 77 |
| Vanadium Removed, % | 86 | 88 |
| Conradson Carbon Conversion, % | 45 | 48 |
| Sulfur Removed, % | 56 | 63 |

As can be seen from the data of Table III, the addition of aqueous HCl improved hydroconversion performance. In the HCl-containing experiment, R-509, desulfurization and Conradson carbon conversion were appreciably better than in the HCl-free control experiment, R-502.

EXAMPLE 4

Comparative hydroconversion experiments (Table IV) were made utilizing as feed a slurry of equal parts by weight of 1-methyl naphthalene and dry Wyodak coal powder of particle size smaller than 100 mesh (Tyler). The thermally decomposable compound used as precursor for the in situ formed catalyst was a phosphomolybdic acid (PMA), 2 $H_3PO_4.24MoO_3.x\ H_2O$, supplied by J. T. Baker and Company, which assayed for 50 wt.% molybdenum. The precursor for in situ formed hydrogen chloride was tertiary-amyl chloride.

In Experiment Number 642, which is an experiment in accordance with the present invention, the 300 cc autoclave reactor described in Example 1 was charged with 82 g of coal slurry and 0.84 g of a blend of PMA and t-amyl chloride in m-cresol, which was prepared by mixing 0.88 g of t-amyl chloride dissolved in 19.12 g of m-cresol to a blend of 0.39 g PMA in 19.61 g of m-cresol. In Experiment Number 643, which is not in accordance with the present invention, the autoclave charge consisted of 81.0 g of coal slurry and 0.84 g of a blend comprised of 0.39 g PMA and 39.61 g of m-cresol. From this point on, the experiments were carried out in an identical manner, which consisted of the following steps. The autoclave containing the coal slurry and catalyst blend was charged at room temperature with 100 psig $H_2S$ and 2,500 psig $H_2$ and then heated to 800° F. for a 60 minute stirred contact. Upon cooling to room temperature, the reactor was depressured to recover gaseous products and the remaining contents were filtered to recover liquid and solid products. The weight of solids obtained after washing with toluene and vacuum oven drying was used to determine the conversion of the coal, said conversion being expressed as conversion based on the weight of dry, ash containing coal charged. The liquid product, recovered by filtration, was analyzed for sulfur, nitrogen and Conradson carbon content.

As can be seen by comparing the experimental results given in Table IV, the addition of the HCl precursor, t-amyl chloride, improved the coal liquefaction performance. In the chloride-containing experiment, No. 642, the coal conversion was higher (less toluene insoluble solids recovered) and the liquid products contained less sulfur and Conradson carbon than in the chloride-free experiment, No. 643.

TABLE IV

WYODAK COAL HYDROLIQUEFACTION WITH CATALYST FORMED IN SITU FROM PHOSPHOMOLYBDIC ACID AND HCl PRECURSOR

| EXPERIMENT NO. | 643 | 642 |
|---|---|---|
| g-Moles HCl/g-atom Mo | 0.00 | 4.10 |
| Autoclave Charge, g. | | |
| Wyodak Coal (dry powder) | 41 | 41 |
| 1-Methyl Naphthalene | 41 | 41 |
| Catalyst Solution | | |
| Phosphomolybdic Acid | 0.0082 | 0.0082 |
| m-Cresol | 0.8318 | 0.8133 |
| t-amyl Chloride | 0.0000 | 0.0063 |
| Coal Conversion, Wt. % | 87.85 | 88.00 |
| Liquid Product Analyses | | |
| Sulfur, Wt. % | 0.45 | 0.39 |
| Conradson Carbon, Wt. % | 9.10 | 8.93 |

What is claimed is:

1. In a process for the hydroconversion of a carbonaceous feed which comprises:

(a) forming a mixture of said carbonaceous feed and a thermally decomposable metal compound wherein said metal compound comprises at least one metal constituent selected from the group consisting of Group II, III, IVB, VB, VIB, VIIB, VIII and mixtures thereof of the Periodic Table of Elements;

(b) reacting the resulting mixture with a hydrogen-containing gas at hydroconversion conditions, in a hydroconversion zone, said metal compound being converted to a metal-containing catalyst within said mixture at said conditions, and (c) recovering a normally liquid hydrocarbon product, the improvement which comprises said reaction being conducted in the presence of a hydrogen halide in an amount such as to provide a ratio from about 0.1 to about 20 gram-moles hydrogen halide per gram-atom of said metal constituent.

2. The process of claim 1 wherein said hydrogen halide or a hydrogen halide precursor is added to said mixture of step (a) or of step (b).

3. The process of claim 1 wherein said hydrogen halide or a hydrogen halide precursor is added to said thermally decomposable metal compound prior to forming said step (a) mixture with said carbonaceous feed.

4. The process of claim 1 wherein said thermally decomposable metal compound is selected from the group consisting of inorganic poly acids, metal carbonyls, metal halides and metal salts of organic acids.

5. The process of claim 1 wherein said thermally decomposable metal compound is a poly acid selected from the group consisting of isopoly acids, heteropoly acids, and mixtures thereof and wherein said poly acid comprises at least one metal constituent selected from the group consisting of Groups VB and VIB of the Periodic Table of Elements.

6. The process of claim 1 wherein said thermally decomposable metal compound is a phosphomolybdic acid.

7. The process of claim 1 wherein said thermally decomposable metal compound is a metal naphthenate.

8. The process of claim 1 wherein said metal compound is added in an amount such as to provide from about 1 to about 2000 wppm of said metal constituent, calculated as elemental metal, based on the weight of said carbonaceous feed.

9. The process of claim 1 wherein said hydroconversion conditions include a temperature ranging from about 600° F. to about 850° F. and a hydrogen partial pressure ranging from about 500 to about 5,000 psig.

10. In the process of claim 1 wherein the effluent of said hydroconversion zone comprises normally liquid hydrocarbon products and a catalytic solid residue, the improvement which comprises the additional steps of separating at least a portion of said catalytic solid residue from said hydrocarbon products and recycling at least a portion of said separated solid residue to said hydroconversion zone.

11. The process of claim 1 wherein said carbonaceous feed comprises a hydrocarbonaceous oil.

12. The process of claim 1 wherein said carbonaceous feed comprises coal.

13. The process of claim 1 wherein said carbonaceous feed comprises a residual oil.

14. The process of claim 1 wherein said hydrogen-containing gas comprises from about 1 to about 10 mole percent hydrogen sulfide.

15. The process of claim 1 wherein said hydrogen halide is present in an amount such as to provide a ratio from about 0.5 to about 10 gram-moles hydrogen halide per gram-atom of said metal constituent.

16. The process of claim 1 wherein said hydrogen halide is present in an amount such as to provide a ratio from about 1 to about 5 gram-moles hydrogen halide per gram-atom of said metal constituent.

* * * * *